US009290863B2

(12) United States Patent
Götz et al.

(10) Patent No.: US 9,290,863 B2
(45) Date of Patent: Mar. 22, 2016

(54) SPINNING UNIT OF AN AIR-JET SPINNING MACHINE

(71) Applicant: Maschinenfabrik Rieter AG, Winterthur (CH)

(72) Inventors: Theodor Gresser Götz, Winterthur (CH); Andreas Fischer, Steckborn (CH)

(73) Assignee: Maschinenfabrik Rieter AG, Winterthur (CH)

( * ) Notice: Subject to any disclaimer, the term of this patent is extended or adjusted under 35 U.S.C. 154(b) by 110 days.

(21) Appl. No.: 14/176,413

(22) Filed: Feb. 10, 2014

(65) Prior Publication Data

US 2014/0223881 A1 Aug. 14, 2014

(30) Foreign Application Priority Data

Feb. 13, 2013 (CH) ..... 444/13
Nov. 12, 2013 (CH) ..... 1885/13

(51) Int. Cl.
*D01H 4/02* (2006.01)
*D01H 1/115* (2006.01)
*D01H 7/92* (2006.01)

(52) U.S. Cl.
CPC ..... *D01H 4/02* (2013.01); *D01H 1/115* (2013.01); *D01H 7/92* (2013.01)

(58) Field of Classification Search
CPC ..... D01H 4/02
See application file for complete search history.

(56) References Cited

U.S. PATENT DOCUMENTS 3,826,073 A * 7/1974 Hoeber et al. ..... 57/345
4,064,684 A * 12/1977 Nijhuis ..... 57/296
6,438,934 B1 * 8/2002 Foster et al. ..... 57/328

* cited by examiner

*Primary Examiner* — Shaun R Hurley
(74) *Attorney, Agent, or Firm* — Dority & Manning, P.A.

(57) ABSTRACT

A spinning unit of an air-jet spinning machine for the spinning of a fiber composite has a pair of delivery rollers and a spinning nozzle, whereas the spinning nozzle has a yarn formation element and a fiber guide element. The fiber guide element has a front turned towards the pair of delivery rollers and an end turned away from the pair of delivery rollers. The fiber composite is fed to the spinning nozzle with the pair of delivery rollers, and is introduced into the spinning nozzle through the fiber guide element, and subsequently a yarn is formed from the fiber composite through the yarn formation element. A tool for feeding an additive to the fiber composite is provided between the pair of delivery rollers and the end of the fiber guide element.

15 Claims, 3 Drawing Sheets

SPINNING UNIT OF AN AIR-JET SPINNING MACHINE

FIELD OF THE INVENTION

The invention relates to a spinning unit of an air-jet spinning machine for the spinning of a fiber composite into a yarn. The spinning unit has a pair of delivery rollers and a spinning nozzle, whereas the spinning nozzle has a yarn formation element and a fiber guide element. The fiber composite is fed with the pair of delivery rollers to the spinning nozzle, and is introduced through the fiber guide element into the spinning nozzle. Subsequently, a yarn is formed through the yarn formation element from the fiber composite.

BACKGROUND

Air-jet spinning machines with correspondingly equipped spinning units are known in the state of the art, and serve the purpose of the production of a yarn from an elongated fiber composite. In such machines, with the assistance of a vortex air flow produced by air jets within the spinning nozzle, the outer fibers of the fiber composite are wound in the area of an inlet mouth of the yarn formation element around the inner core fibers, and ultimately form the wrapped fibers crucial for the desired strength of the yarn. This creates a yarn with a twist, which ultimately can be led away from the spinning nozzle through a yarn guide channel and, for example, wound on a spool.

Spinning units conforming to this type are known in the state of the art, whereas the term "yarn" is generally understood to mean a fiber composite, for which at least one part of the fibers is wound around an inner core. As such, this includes, for example, a yarn in the conventional sense, which may be processed into a fabric, for instance with the assistance of a weaving machine. Likewise, the invention relates to spinning units of air-jet spinning machines, with the assistance of which so-called "roving" (another name: coarse roving) can be produced. Such roving is distinguished by the fact that, despite a certain strength, which is sufficient for carrying the yarn to a subsequent textile machine, it is still capable of being drafted. Thus, the roving can be drafted with the assistance of a drafting device, for example, the drafting system of a textile machine processing the roving, for example a ring spinning machine, before it is finally spun. For the purposes of this invention, the term "yarn" is understood to include yarn or roving produced with an air-jet spinning machine.

The production of man-made fibers, such as polyester, or mixtures of natural and man-made fibers, results in deposits on the surface of the yarn formation element. The production of man-made fibers includes a so-called "preparation" of the continuous fibers during the production process, wherein a preparation agent, mostly oils with various additives, is applied on the continuous fibers, which enables treatment of, for example, drafting of continuous fibers at high speeds. Such preparation agents sometimes adhere to the man-made fibers in further treatment, and lead to impurities in the air-jet spinning machine. Typically, the fibers fed to the air-jet spinning machine in the form of a fiber composite are fed to the spinning nozzle through a pair of delivery rollers. The pair of delivery rollers may correspond to a pair of output rollers of a drafting system. Drafting systems that are used serve the purpose of refining the advanced fiber composite prior to entering the spinning nozzle.

A fiber guide element is arranged in the entrance area of the spinning nozzle, through which the fiber composite is guided into the spinning nozzle to the yarn formation element. Multiple spindles with an inner yarn guide channel may be used as yarn formation elements. At the top of the yarn formation element, compressed air is introduced through the housing wall of the spinning nozzle in such a manner that a rotating vortex air flow arises. As a result, individual external fibers are separated from the fiber composite leaving the fiber guide element, and are turned over through the top of the yarn formation element. In the further course, these fibers that have broken away rotate on the surface of the yarn formation element. Subsequently, through the forward movement of the inner core fibers of the fiber composite, the rotating fibers are wound around the core fibers, and a yarn is thereby formed. Through the movement of the individual fibers on the surface of the yarn formation element, deposits form on the yarn formation element due to the buildups on the fibers from the production process. Deposits on the yarn formation element may also be caused by damaged fibers. For the same reasons, deposits may also arise on the surface of the interior of the spinning nozzle or the fiber guide element. These buildups lead to a deterioration of the surface condition of the yarn formation element, and cause a reduction in the quality of the yarn that is produced. A regular cleaning of the affected surfaces is necessary in order to be able to maintain a consistent quality of the spun yarns.

The cleaning of the surfaces of the yarn formation element, the interior of the spinning nozzle and the fiber guide element may take place manually through the periodic disassembly of the yarn formation element, but this leads to substantial maintenance, connected with a corresponding interruption in operations.

EP 2 450 478 discloses a device that allows for automatic cleaning to be carried out without stopping the machine. For this purpose, an additive is mixed with the compressed air used for the formation of vortex air flow within the spinning nozzle. The additive is guided by the compressed air to the yarn formation element, and results in the cleaning of the surface of the yarn formation element. It is disadvantageous to the disclosed cleaning system that, for the feeding of the additive, an additional compressed air supply of all of the spinning units of the air-jet spinning machine is necessary and, as a result of this, a complex governing of the dosing of the additive is to be provided in order to avoid an overdosing of the additive when individual spinning units have stopped. Moreover, the additive must be fed into a surrounding area with an increased ambient pressure, namely the air supply of the spinning nozzle, which makes corresponding demands on the dosing device for the adjustment to a momentarily prevailing ambient pressure.

JP-2008-095-208 discloses a further design of a cleaning of the yarn formation element. An additive is also fed to the compressed air used for agitation in the spinning nozzle, and is guided with this compressed air into the spinning nozzle and thus to the yarn formation element. In the disclosed design, the dosing and the addition of the additive is provided separately for each spinning unit. Also in this design, the additive must be fed into a surrounding area with an increased ambient pressure, which makes high demands on the dosing device.

SUMMARY OF THE INVENTION

A task of the invention is to create a spinning unit with a device that enables the cleaning of the yarn formation element, the fiber guide element, and the interior of the spinning nozzle with the assistance of an additive, whereas the feeding and dosing of the additive are to take place independent of the pressure conditions in the spinning nozzle. Additional objects and advantages of the invention will be set forth in part in the following description, or may be obvious from the description, or may be learned through practice of the invention.

A novel spinning unit is proposed to solve the task. The spinning unit of an air-jet spinning machine for the spinning of a fiber composite into a yarn has a pair of delivery rollers and a spinning nozzle, whereas the spinning nozzle has a yarn formation element and a fiber guide element with a front turned towards the pair of delivery rollers and an end turned away from the pair of delivery rollers. The fiber composite is fed with the pair of delivery rollers to the spinning nozzle, and is introduced into the spinning nozzle through the fiber guide element. Subsequently, a yarn is formed from the fiber composite through the yarn formation element. A tool for feeding an additive to the fiber composite is provided between the pair of delivery rollers and the end of the fiber guide element.

Air-jet spinning machines typically have several spinning units. At each spinning unit, a yarn is produced from the advanced fiber composite, independent of the other spinning units. The independence of the individual spinning units from each other may be so extensive that different yarns, or yarns from different materials, can be produced on neighboring spinning units.

The advanced fiber composite consists of a collection of individual fibers that are aligned in the longitudinal direction of the fiber composite. The fibers of a fiber composite may consist of various materials. Man-made fibers made of various plastics and cotton fibers, and mixtures thereof, are frequently used. When using man-made fibers or mixtures with man-made fibers, such as polyester fibers, impurities build up within the spinning nozzle, which have their origins in the production of the man-made fibers. Due to the production process, such buildups carried along with the fibers cannot be avoided. Likewise, the formation of deposits by damaged fibers cannot be avoided.

The spinning unit of an air-jet spinning machine for the spinning of a fiber composite into a yarn has at least one pair of delivery rollers and one spinning nozzle. If a drafting system is present, the pair of delivery rollers may correspond to a pair of output rollers of such drafting system. However, it is also possible to arrange an extra pair of delivery rollers for the feeding of the fiber composite to the spinning nozzle. The spinning nozzle has a yarn formation element and a fiber guide element; these are arranged in a housing. Through holes provided in the housing, compressed air is introduced into the spinning nozzle. The holes are arranged in such a manner that a rotating vortex air flow arises within the housing, which, with the assistance of the yarn formation element, leads to the transformation of the fiber composite into yarn or roving. The fiber composite is introduced into the spinning nozzle through the fiber guide element. The fiber guide element has a front turned towards the pair of delivery rollers and an end turned away from the pair of delivery rollers. The fiber composite fed by the pair of delivery rollers to the spinning nozzle traverses the fiber guide element from its start to end, and guided in this manner, reaches the yarn formation element, or the rotating air flow.

Fiber guide elements are known in the state of the art in various designs. For example, fiber guide elements, which guide the fiber composite on a flat or a curved sliding surface, are used. The compressed air introduced in the spinning nozzle in part leaves from the spinning nozzle, together with the yarn, and in part is brought out from the spinning nozzle through an exhaust duct. Due to the air conveyance in the spinning nozzle and the flow conditions resulting from this, suction arises in the fiber guide element. Through the flow conditions in the spinning nozzle, ambient air is sucked into the spinning nozzle through the fiber guide element. Given this, there is a vacuum at the entry site of the fiber composite in the fiber guide element. The suction effect on the surrounding area is enhanced by the fiber composite moving into the fiber guide element. The invention makes use of this circumstance by the fact that a tool for feeding an additive to the fiber composite is provided between the pair of delivery rollers and the end of the fiber guide element.

Thus, the additive is introduced into an area with a slight vacuum in respect of the surrounding area of the spinning unit. In addition, the additive is transported into the spinning nozzle through the fibers. An addition of the additive to the fiber composite in the area between the terminal point of the pair of delivery rollers and the end of the fiber guide element simplifies the selection of the tool for feeding the additive, along with its dosing. In the selected area, there are pressure conditions that change only insignificantly when there is a change in the spinning performance.

The tool for feeding the additive in the provided area has, in a first embodiment, a transport line and a hollow needle. Through the transport line, the additive is forwarded to the hollow needle from an additive storage device. The additive storage device is designed depending on the selection of the additive, and may be provided by, for example, a tank, a distribution system, or storage cartridges assigned to individual spinning units. Many types of storage devices of various materials can be found in the relevant state of the art. A "hollow needle" is understood to be a duct with an internal diameter of 0.01 mm to 1.0 mm and an outer diameter of 0.2 mm to 1.5 mm. The selection of materials for the hollow needle is to be coordinated for the additive to be used. The hollow needle may be made from a metal or its alloys, along with plastic. It is also conceivable to produce a pliable or flexible hollow needle from a hose or a hose-like source material.

The hollow needle is connected to the transport line, and has a free discharge outlet at its end. The discharge outlet is directed against the fiber composite. The additive exits through the discharge outlet and is taken up by the fiber composite going past the free opening, supported by the suction through the air sucked into the spinning nozzle. The dimension of the cross-section of the hollow needle and the material of the hollow needle, along with the formation of the discharge outlet of the hollow needle, are to be selected in a manner corresponding to the properties of the additive to be added and its quantity.

The design of the discharge outlet of the hollow needle may be varied. For example, it may be provided in a location slanted to the axis of the hollow needle. A nozzle shape or an expanding discharge outlet is also conceivable. Moreover, the discharge outlet may be additionally equipped with a spray head. A spray head serves the purpose of better distributing the additive through a dispersal of the additive into fine component parts. In a preferred embodiment, the hollow needle has a slot-shaped discharge outlet opposite the fiber composite. Thus, the exiting additive may be evenly distributed across the entire width of the fiber composite moving over to the hollow needle.

In a further embodiment, the tool for feeding the additive has a transport line and a hole. Through the transport line, the additive is guided from the additive storage device to a hole in the fiber guide element. Depending on the arrangement of the fiber guide element in the spinning nozzle and the selection of the arrangement of the introduction of the additive, the hole also penetrates the spin housing. The discharge outlet of the hole directs to the fiber composite sliding through the fiber guide element. The dimension of the cross-section of the hole, along with the formation of the discharge outlet of the hole, are to be selected according to the additive to be fed and its quantity. Moreover, the expansion of the discharge outlet of the hole may be designed in such a manner that the entire width of the fiber guide element is covered. The hole through the housing and the fiber guide element may also be designed in such a manner that there can be an introduction of various hollow needles by which the additive is brought to the fiber composite.

In a preferred design of the spinning unit, a dosing device is provided in the transport line. The dosing device includes a dosing unit for the active dosing of the additive quantity and a control element for the adjustment of the dosing unit. Valves of various construction types, such as dosing pumps, for example gear pumps, hose squeeze pumps or membrane pumps, are suitable as dosing units. However, the dosing device may also consist of a simple, mechanically lockable throttle, along with a shut-off valve that can be triggered by, for example, the mechanical actuation by hand on the part of the service personnel.

The spinning performance of modern air-jet spinning machines lies between 200 m and 600 m of yarn per minute. Corresponding to the momentary spinning performance of a spinning unit, the dosed quantity of the additive to be added is to be adjusted. Through a regulated dosing, the quantity of the additive may be adjusted to the particular spinning performance of a spinning unit. Moreover, the dosing depends on the properties of the additive to be dosed and the material to be spun.

The selection of the additive also gives rise to the possibility of having an influence on the properties of the yarn to be produced. For example, through the additives that are to be added to the fiber composite, certain effects in the produced yarn can be achieved. In the combination of the selection of materials of the fiber composite and the corresponding additive, it is also possible to reinforce, or change, certain yarn properties, such as strength or visual appearance, compared to a production of yarn with the same fiber composite without the addition of an additive. Due to this aspect, an addition of an additive is also useful if cleaning the yarn formation element is not necessary, as this is the case with the processing of natural fibers, such as cotton.

The type of the additive includes both liquids or solid particles or gaseous media, and all mixes of them. For example, as an additive, a cleaning fluid or water, or water with the admixture of a cleaning fluid, is advantageous if there are strong impurities in the yarn formation element. However, the addition of solid particles for cleaning purposes is also conceivable. To affect the properties of the yarn, various chemical additives may be used, by which the strength or the visual appearance (for example) of the produced yarn may be affected. With a mixture of the options set forth above, an improvement or change to the properties of the yarn, and the cleaning of the yarn formation element, may be achieved.

For the addition of liquid additives, in particular for cleaning the yarn formation element, it has proved advantageous if the dosing device has a liquid dosing with a dosing range of 0.1 ml to 7.0 ml per minute. A dosing range of 0.5 ml to 1.5 ml per minute is particularly preferred.

For the addition of liquid additives, in particular for improving the yarn properties, it has proved advantageous if the dosing device has a liquid dosing with a dosing range of 0.01 ml to 1.0 ml per minute. In order to achieve the cleaning of the yarn formation element in addition to the improved yarn properties, it is preferable that an interval cleaning with a higher dosing of up to 7.0 ml per minute is provided. The intervals to be undertaken depend on the degree of contamination of the yarn formation element, and may vary from once per day to several times per hour. The duration of the interval depends on the cleaning effort needed, and may last from fractions of a second up to several seconds.

Advantageously, a dosing device that is able to be employed for cleaning and yarn impact accordingly has a liquid dosing with a dosing range of 0.01 ml to 7.0 ml per minute.

For the addition of solid particles as additives, in particular for producing an effect yarn or cleaning the yarn formation element, it has proved advantageous if the dosing device has a solid substance dosing with a dosing range of 0.1 g to 7.0 g per minute. A dosing range of 0.5 g to 1.5 g per minute is particularly preferred.

For the addition of gaseous additives such as steam, in particular for producing an effect yarn, it has proved advantageous if the dosing device has a dosing range of 0.1 ml to 7.0 ml per minute. A dosing range of 0.5 ml to 1.5 ml per minute is particularly preferred.

If, with the addition of additives, the cleaning of the yarn formation element is sought, it is sufficient that an intermittent dosing is provided. Due to the material of the fiber composite to be processed, the duration of the feeding of an additive and the necessary interval between the dosings can be determined by the satisfactory cleaning of the yarn formation element being achieved, without affecting the properties of the yarn that is produced for a long period of time. In order to enable an intermittent dosing, the feeding of the additive may be opened and closed, for instance with a valve. This has the advantage that an existing dosing of the additive is not adjusted by the switching on and off of the feeder. A similar control device of the dosing may also be provided for a switch between a low dosing for affecting the properties of the yarn and a short-term increase of the dosing for cleaning the yarn formation element.

In one advantageous embodiment of the device, there is the option that the tool for feeding the additive is switchable between various additives. This has the advantage that, for the feeding of an additive for the purpose of affecting the properties of the yarn that is produced, a short-term supplemental addition of the cleaning agent is possible, without disrupting the addition of the additive for the purpose of affecting the properties of the yarn that is produced. Moreover, various additives for producing an effect yarn in a certain rhythm may be fed in an alternating manner.

The task that is posed is likewise solved in accordance with aspects of the invention by a method for feeding an additive to a fiber composite at a spinning unit of an air-jet spinning machine with a pair of delivery rollers and a spinning nozzle, by the fact that an additive is fed to the fiber composite between the pair of delivery rollers and the end of the fiber guide element. In a preferred procedure, the additive is brought through a transport line with a dosing device to a tool for feeding it to the fiber composite.

In a first design of the method, the dosing device is controlled in such a manner that, through the additive that is fed, there is a cleaning of the yarn formation element. In a further design, the dosing device may be controlled in such a manner that the feeding of the additive is undertaken in coordination with the desired properties of the yarn that is produced or the momentary spinning performance of the spinning unit.

By the fact that the addition of an additive at a spinning unit is independent of the other spinning units, an air-jet spinning machine may be equipped with one or more spinning units with corresponding tools for feeding an additive.

In a preferred design of an air-jet spinning machine, a switching between the feeding of different additives or different tools for feeding the additive to the fiber composite is provided on a single spinning unit or different spinning units. In this design, it is possible, for example, to feed different additives to different spots of the fiber composite. This may be advantageous if the additives must be fed successively or alternately, but a very rapid sequence of switching is to be achieved.

BRIEF DESCRIPTION OF THE DRAWINGS

In the following, the invention is described on the basis of an exemplary embodiment and illustrated in greater detail through drawings.

DETAILED DESCRIPTION

Figure 1:
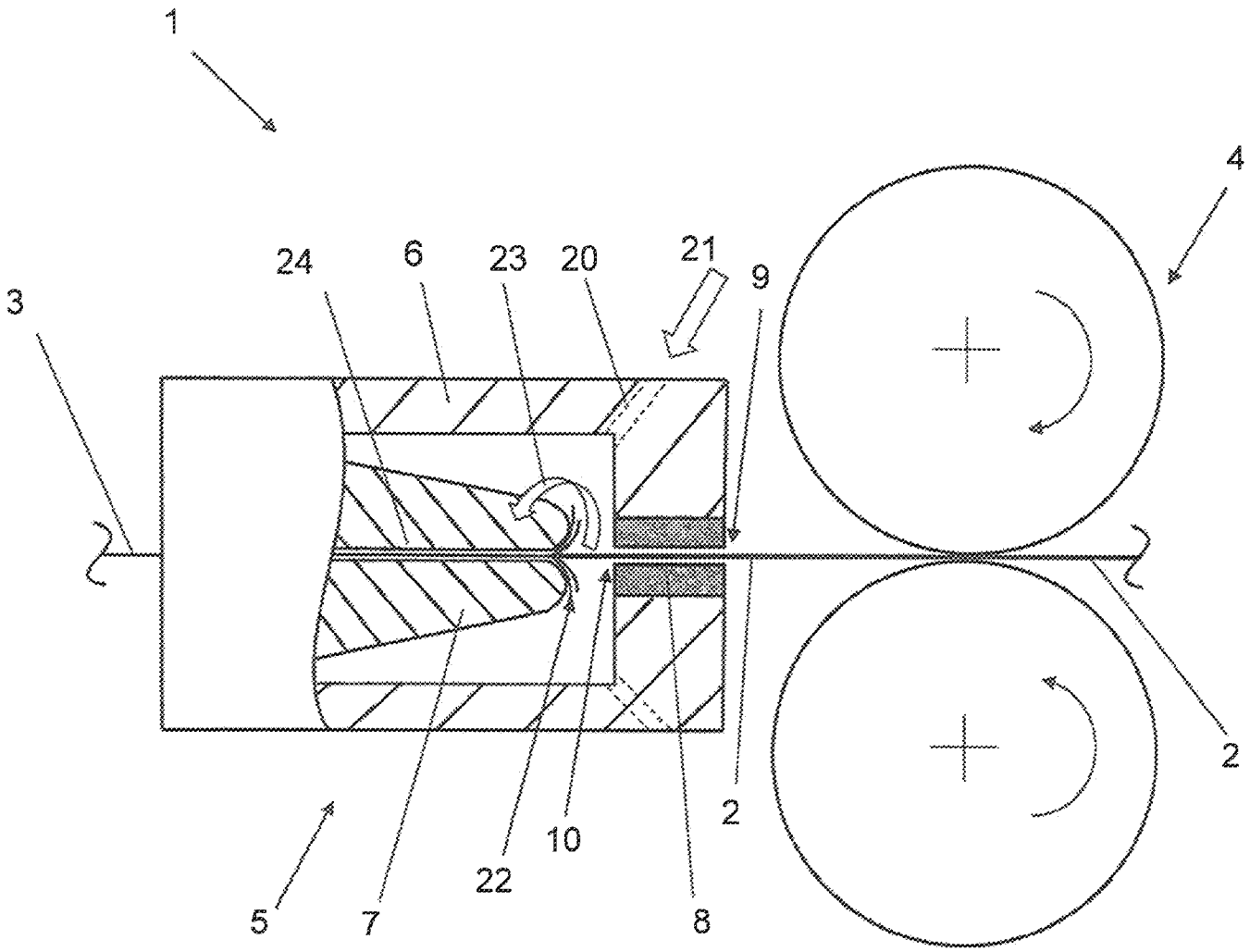
FIG. 1 is a schematic representation of a spinning unit of an air-jet spinning machine according to the state of the art.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic representation of a spinning unit 1 of an air-jet spinning machine according to the state of the art. The represented spinning unit 1 has a spinning nozzle 5 and a pair of delivery rollers 4. The spinning nozzle 5 has a housing 6 and a yarn formation element 7 at least partially located in the housing 5. The housing 6 is, opposite to the pair of delivery rollers 4, penetrated by a fiber guide element 8. The fiber guide element 8 has a front 9 turned towards the pair of delivery rollers 4 and an end 10 turned away from the pair of delivery rollers 4. The end 10 of the fiber guide element 8 is turned towards the yarn formation element 7. The figure indicates the compressed air inlets 20 in the housing 6, through which the compressed air 21 is introduced for the production of a rotating vortex flow 22 at the top of the yarn formation element 7 into the spinning nozzle 5. The fiber composite 2 is fed through the pair of delivery rollers 4 of the spinning nozzle 5. The fiber composite 2 is guided into the spinning nozzle 5 through the fiber guide element 8. After the entry of the fiber composite 2, through the vortex flow, individual external fibers 23 break away from the fiber composite 2. Since the individual fibers 23 are collected by the yarn formation element 7 with their one end, the other end of the individual fibers 23 is turned over through the top of the yarn formation element 7 and are subsequently wound around the inner fibers of the fiber composite 2 that are not affected. The resulting yarn 3 is delivered from the spinning nozzle 5 through a yarn guide channel 24 arranged inside of the yarn formation element 7.

The pair of delivery rollers 4 may be identical to the pair of outlet rollers of an upstream drafting system (not shown). Likewise, a pair of discharge rollers (not shown) may be arranged at the outlet of the spinning nozzle 5.

Figure 2:
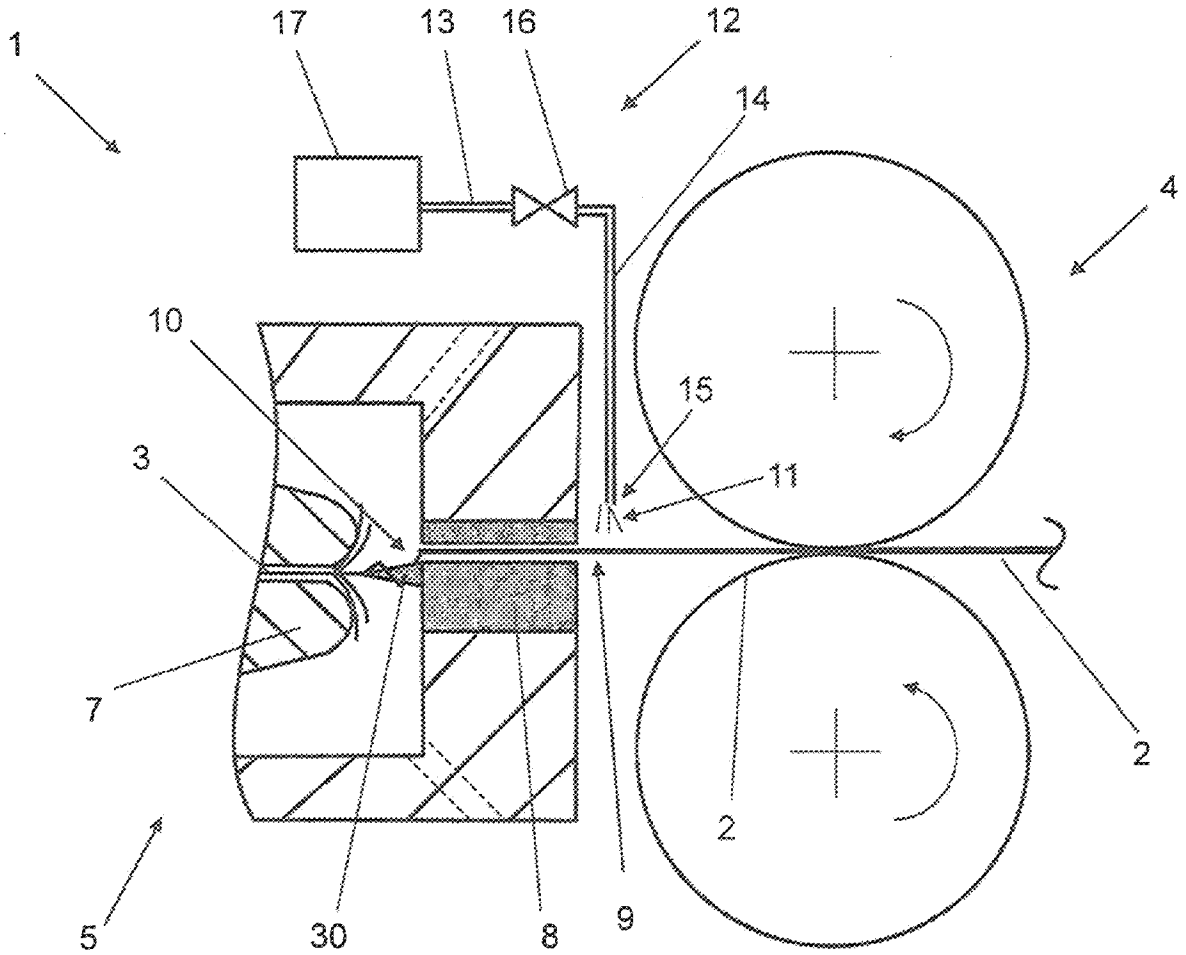
FIG. 2 is a schematic representation of a first design of a spinning unit of an air-jet spinning machine.

FIG. 2 shows a schematic presentation of a first design of a spinning unit 1 of an air-jet spinning machine in accordance with aspects of the invention. The fiber composite 2 is fed to the fiber guide element 8 through the pair of delivery rollers 4. Through the fiber guide element 8, from its front 9 to its end 10, the fiber composite 2 is guided into the spinning nozzle 5. In the design that is shown, the fiber guide element 8 is provided with a so-called "pin" 30 after its end 10. The pin 30 serves the purpose of reversing the fiber composite 2 upon entering the spinning nozzle 5. Subsequently, as described under FIG. 1, the fiber composite 2 is transformed into a yarn 3 with the assistance of the yarn formation element 7.

A tool 12 for feeding an additive 11 is provided between the pair of delivery rollers 4 and the front 9 of the fiber guide element 8. The tool 12 includes a transport line 13 and a hollow needle 14. Through the transport line 13, the additive is guided to the hollow needle 14. The hollow needle 14 is a very fine duct, which enables a precise dosing of the smallest quantities of additives 11 to the fiber composite 2. In its expansion, the discharge outlet 15 of the hollow needle 14 is adapted to the dosed quantity of the additive 11. The transport line 13 is separated from the hollow needle 14 with a valve 16. A dosing device 17 is also provided in the transport line 13. The quantity of the additive 11 is governed by the dosing device 17 and the feeding of the additive 11 can be switched on or off by the valve 16.

Figure 3:
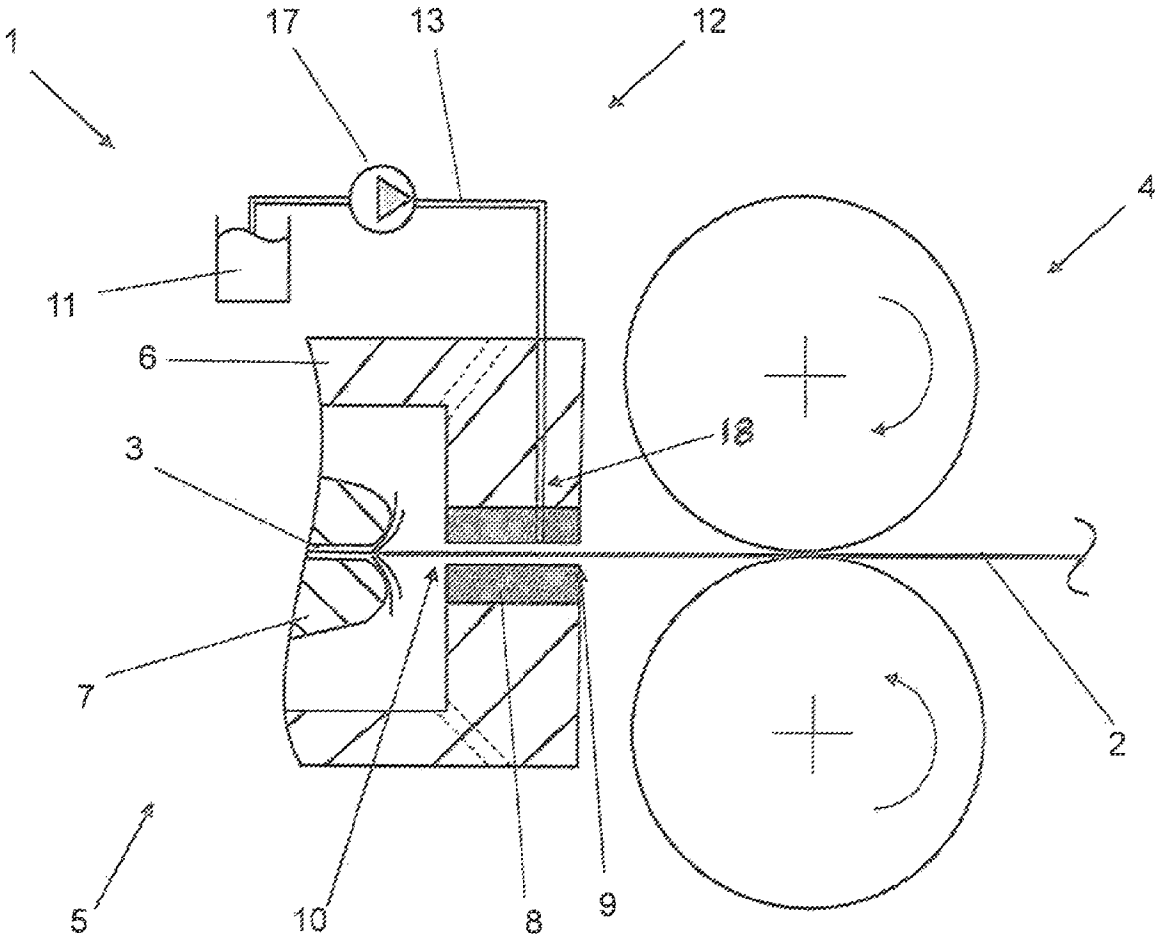
FIG. 3 is a schematic representation of a second design of a spinning unit of an air-jet spinning machine.

FIG. 3 shows a schematic representation of a second design of the spinning unit 1 of an air-jet spinning machine. The fiber composite 2 is fed to the fiber guide element 8 through the pair of delivery rollers 4. Through the fiber guide element 8, from its front 9 to its end 10, the fiber composite 2 is guided into the spinning nozzle 5. In the design that is shown, the fiber guide element 8 is schematically presented. There are various designs of the fiber guide element 8 known from the state of the art, as are the actual guide surfaces on which the fiber composite 2 is to be carried out in the design in a sliding manner. After the entry of the fiber composite 2 in the interior of the spinning nozzle 5, as described under FIG. 1, the fiber composite 2 is transformed into a yarn 3 with the assistance of the yarn formation element 7.

Between the front 9 and the end 10 of the fiber guide element 8, a tool 12 for feeding an additive 11 to the fiber composite 2 is provided. The tool 12 includes a transport line 13 and a hole 18 through the housing 6 of the spinning nozzle 5 and the fiber guide element 8. The additive 11 is guided to the hole 18 through the transport line 13. A pump is provided as the closing device 17 for the dosing of the additive 11 in the transport line 13.

Modifications and variations can be made to the embodiments illustrated or described herein without departing from the scope and spirit of the invention as set forth in the appended claims.

The invention claimed is:

1. A spinning unit of an air-jet spinning machine for spinning a fiber composite into a yarn, comprising:

a pair of delivery rollers;

a spinning nozzle disposed to receive the fiber composite from the delivery rollers, the spinning nozzle further comprising:

a housing;

a yarn formation element;

a fiber guide element comprising a front oriented towards the delivery rollers and an opposite end oriented towards the yarn formation element;

the fiber composite introduced into the spinning nozzle through the fiber guide element; and an additive tool configured between the pair of delivery rollers and the opposite end of the fiber guide element at a location to introduce an additive to the fiber composite between the delivery rollers and the end of the fiber guide element prior to the fiber composite being spun into a yarn by the yarn formation element.

2. The spinning unit as in claim 1, wherein the additive tool comprises a transport line for the additive in communication with a hollow needle.

3. The spinning unit as in claim 2, wherein the hollow needle comprises a slot-shaped discharge outlet oriented transversely from a path of the fiber composite.

4. The spinning unit as in claim 1, wherein the additive tool comprises a transport line for the additive in communication with a hole defied defined through the housing and the fiber guide element.

5. The spinning unit as in claim 1, wherein the additive tool comprises a transport line for the additive, and a dosing device configured in the transport line.

6. The spinning unit as in claim 5, wherein the dosing device comprises one of a pump or a valve.

7. The spinning unit as in claim 5, wherein the dosing device is a liquid dosing device having a dosing rate range of 0.01 ml/min to 7.0 ml/min.

8. The spinning unit as in claim 5, wherein the dosing device is a solid substance dosing device having a dosing rate range of 0.1 g/min to 7.0 g/min.

9. The spinning unit as in claim 5, wherein the dosing device is a gas or steam dosing device having a dosing rate range of 0.1 ml/min to 7.0 ml/min.

10. The spinning unit as in claim 5, wherein the dosing device is configured for intermittent dosing of the additive.

11. The spinning unit as in claim 1, wherein the additive tool comprises a transport line for the additive and is configured to switch between different additives delivered through the transport line.

12. A method for feeding an additive to a fiber composite at a spinning unit of an air-jet spinning machine, comprising:

conveying the fiber composite from a pair of delivery rollers to a spinning nozzle, and introducing the fiber composite into the spinning nozzle through a fiber guide element, wherein the fiber composite is spun into a yarn with a yarn formation element in the spinning nozzle; and delivering an additive to the fiber composite at a location between the pair of delivery rollers and an end of the fiber guide element that is oriented towards the yarn formation element.

13. The method as in claim 12, further comprising delivering the additive with a dosing device that is controlled so as to result in a cleaning of the yarn formation element by the additive.

14. An air-jet spinning machine comprising a plurality of spinning units for spinning a fiber composite into a yarn, wherein at least one of the spinning units further comprises:

a pair of delivery rollers;

a spinning nozzle disposed to receive the fiber composite from the delivery rollers, the spinning nozzle further comprising:

a housing;

a yarn formation element;

a fiber guide element comprising a front oriented towards the delivery rollers and an opposite end oriented towards the yarn formation element;

the fiber composite introduced into the spinning nozzle through the fiber guide element; and an additive tool configured between the pair of delivery rollers and the opposite end of the fiber guide at a location to introduce an additive to the fiber composite between the delivery rollers and the end of the fiber guide element prior to the fiber composite being spun into a yarn by the yarn formation element.

15. The air-jet spinning machine as in claim 14, wherein the additive tool comprises a transport line for the additive and is configured to switch between different additives delivered through the transport line to an individual spinning unit or different spinning units.

* * * * *